US008145106B2

(12) United States Patent
Miyamoto et al.

(10) Patent No.: US 8,145,106 B2
(45) Date of Patent: Mar. 27, 2012

(54) ANNULAR BODY, ANNULAR BODY STRETCHING DEVICE AND IMAGE FORMING APPARATUS

(75) Inventors: Masahiko Miyamoto, Kanagawa (JP); Nobuyuki Ichizawa, Kanagawa (JP); Yousuke Tsutsumi, Kanagawa (JP); Taku Fukuhara, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 806 days.

(21) Appl. No.: 12/235,221

(22) Filed: Sep. 22, 2008

(65) Prior Publication Data

US 2009/0245893 A1 Oct. 1, 2009

(30) Foreign Application Priority Data

Mar. 26, 2008 (JP) ..... 2008-082019

(51) Int. Cl.
*G03G 15/01* (2006.01)

(52) U.S. Cl. ..... 399/302; 399/297

(58) Field of Classification Search ..... 399/297, 399/302

See application file for complete search history.

(56) References Cited

U.S. PATENT DOCUMENTS

2006/0072939 A1* 4/2006 Kremer et al. ..... 399/130

FOREIGN PATENT DOCUMENTS

| | | |
|---|---|---|
| JP | A-8-30109 | 2/1996 |
| JP | A-11-45010 | 2/1999 |
| JP | A-2004-46277 | 2/2004 |
| JP | 2004-295070 | * 10/2004 |
| JP | A-2005-62553 | 3/2005 |
| JP | A-2005-91789 | 4/2005 |
| JP | A-2006-184547 | 7/2006 |

* cited by examiner

*Primary Examiner* — David Gray
*Assistant Examiner* — Roy Y Yi
(74) *Attorney, Agent, or Firm* — Oliff & Berridge, PLC

(57) ABSTRACT

The invention provides an annular body provided at an image forming apparatus, the annular body has at least an outermost periphery layer and an innermost periphery layer, each of which comprise carbon black, and a content of carbon black contained per unit of volume of the outermost periphery layer being smaller than a content of carbon black contained per unit of volume of the innermost periphery layer. The invention further provides an annular body stretching device, having at least the annular body and a plurality of annular body stretching units rotatably stretching the annular body at an inner surface of the annular body. The invention further provides an image forming apparatus having at least an image holder, a charging device, an exposing device, a developing device, a first transferring device, a second transferring device, and a fixing device, in which the intermediate transfer belt is the annular body.

14 Claims, 4 Drawing Sheets

ANNULAR BODY, ANNULAR BODY STRETCHING DEVICE AND IMAGE FORMING APPARATUS

CROSS-REFERENCE TO RELATED APPLICATION

This application claims priority under 35 USC 119 from Japanese Patent Application No. 2008-082019 filed Mar. 26, 2008.

BACKGROUND

1. Technical Field

The present invention relates to an annular body, an annular body stretching device and an image forming apparatus.

2. Related Art

A conventional electrophotographic process used with an image forming apparatus typically includes: forming an electrostatic latent image on an image holder such as an electrophotographic photoreceptor, developing the electrostatic latent image with a toner, electrostatically transferring a thus-obtained toner image to an intermediate transfer belt that is an endless belt (first transfer process), and further transferring the toner image to a transfer receiver medium such as a transfer paper to form an image (secondary transfer process). In a (tandem) image forming apparatus where toner images of a plurality of different colors are superposed to form a full-color image, an intermediate transfer belt has been suitably used and, in particular, an intermediate transfer belt having conductive properties has been in wide use.

In order to stably obtain an excellent output image over a long term, in addition to mechanical strength such as flexibility, bending resistance and tensile rupture strength, electrical characteristics such as surface resistivity and volume resistivity are important for the intermediate transfer belt.

SUMMARY

However, in an image forming apparatus that uses the annular body (intermediate transfer belt), regions where toner images are absent are generated on an output image (fine white spots).

The present inventors have found that the phenomenon of fine white spots can be caused by electrons flowing to the annular body from a first transfer member, in contact with an inner surface side of the annular body in the first transfer means, and from a second transfer member, in contact with an inner surface side of the annular body in the second transfer means. More specifically, the inventors have found that, when electrons flowing to the annular body flow through the inside of the annular body and reach an outer periphery surface thereof, then, at the outer periphery surface of the annular body, positive charges and electrons are pair-annihilated and form a current discharge path from an interior surface side of the annular body to an exterior surface side thereof. As a result, a discharge current increases, generating fine white spots.

Furthermore, the inventors have found that fine white spots due to an increase in the discharge current become more remarkable as input voltage increases, caused by, for example, a high processing speed or the like.

The present invention provides an annular body by which image defect of fine white spots on an output image is suppressed from occurring to enable to obtain an excellent output image, an annular body stretching device with the annular body and an image forming apparatus.

Namely, a first aspect of the invention is an annular body provided at an image forming apparatus, the annular body comprising at least an outermost periphery layer and an innermost periphery layer, each of which comprise carbon black, and a content of carbon black contained per unit of volume of the outermost periphery layer being smaller than a content of carbon black contained per unit of volume of the innermost periphery layer.

A second aspect of the invention is an annular body stretching apparatus, comprising the annular body and a plurality of annular body stretching units rotatably stretching the annular body at an inner surface of the annular body.

A third aspect of the invention is an image forming apparatus comprising:

an image holder;

a charging device for charging the image holder;

an exposing device for forming an electrostatic latent image on the image holder charged by the charging device;

a developing device for developing the electrostatic latent image as a toner image;

a first transferring device for transferring the toner image from the image holder to an intermediate transfer belt;

a second transferring device for transferring the toner image from the intermediate transfer belt to a transfer receiving medium; and a fixing device for fixing the transferred toner image onto the transfer receiving medium, and the intermediate transfer belt being the annular body.

BRIEF DESCRIPTION OF THE DRAWINGS

Exemplary embodiments of the invention will be described in detail based on the following figures, wherein.

DETAILED DESCRIPTION

Hereinafter, preferred exemplary embodiments of the present invention will be described in detail will be detailed with reference to the drawings.

Figure 1:
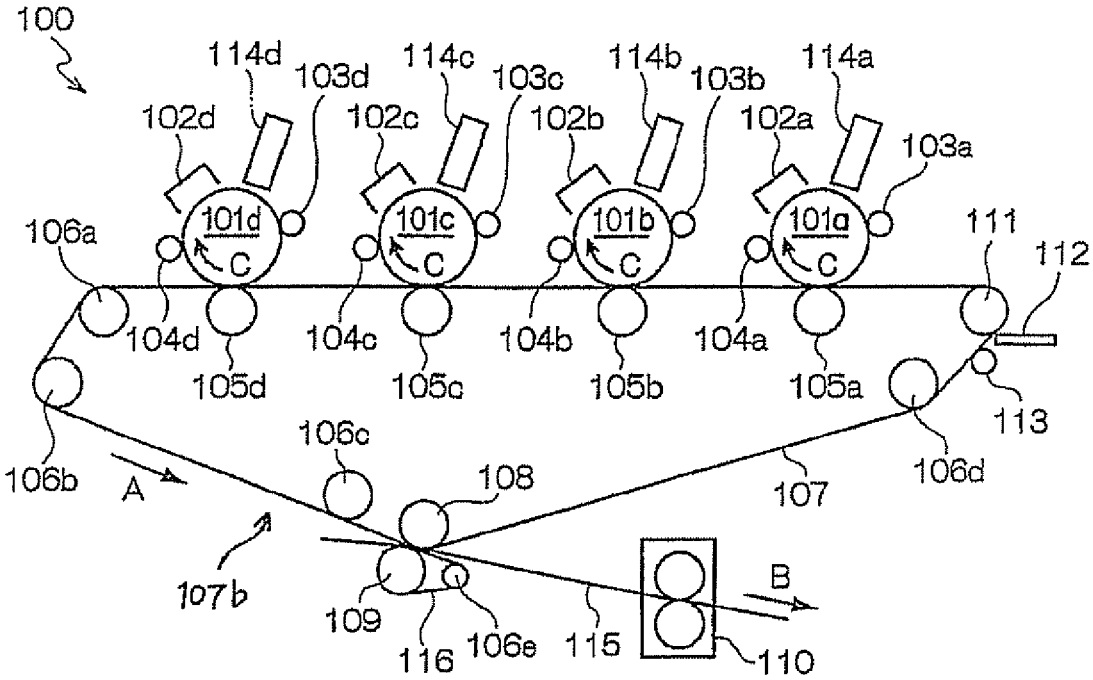
FIG. 1 is a schematic sectional diagram illustrating an example of the image-forming apparatus according to one exemplary embodiment of the invention.

FIG. 1 is a schematic diagram showing a configuration of an image forming apparatus involving one exemplary embodiment of the invention. An image forming apparatus 100 involving the exemplary embodiment is a so-called tandem apparatus. Around four image holders 101*a* through 101*d*, each of which are made of an electrophotographic photoreceptor, charging devices 102*a* through 102*d*, exposing devices 114*a* through 114*d*, developing devices 103*a* through 103*d*, first transfer devices (first transfer roll) 105*a* through 105*d*, and image holder cleaning devices 104*a* through 104*d* are sequentially disposed along a direction of revolution of the apparatus. The image forming apparatus may be further provided with static eliminators for removing residual potential remaining on surfaces of the image holders 101*a* through 101*d* after the transferring.

The intermediate transfer belt 107, which is one exemplary embodiment of the annular body of the invention, is stretched over tension rolls 106*a* through 106*d*, a drive roll 111 and a backup roll 108, which work as annular body stretching units, to form an annular body stretching device (belt stretching device) 107*b*. Owing to the tension rolls 106*a* through 106*d*, drive roll 111 and backup roll 108, the intermediate transfer belt 107 may move between the respective image holders 101*a* through 101*d* and the first transfer rolls 105*a* through 105*d* in a direction of an arrow mark A while coming into contact with surfaces of the respective image holders 101*a* through 101*d*. Portions where the first transfer rolls 105*a* through 105*d* come into contact through the intermediate transfer belt 107 with the image holders 101*a* through 101*d* are first transfer portions. A first transfer voltage is applied to the contact portions of the image holders 101*a* through 101*d* and the first transfer rolls 105*a* through 105*d*.

As a second transfer device, the backup roll 108 and second transfer roll 109 are oppositely disposed through the intermediate transfer belt 107 and second transfer belt 116. A transfer receiver medium 115 such as paper travels between the intermediate transfer belt 107 and the second transfer roll 109 in a direction of an arrow mark B while coming into contact with a surface of the intermediate transfer belt 107, and, thereafter, goes past a fusing device 110. A portion where the second transfer roll 109 comes into contact through the intermediate transfer belt 107 and the second transfer belt 116 with the backup roll 108 is a second transfer portion. A second transfer voltage is applied to a contact portion of the second transfer roll 109 and the backup roll 108. Further, intermediate transfer belt cleaning devices 112 and 113 are disposed so as to come into contact with the intermediate transfer belt 107 after the transferring.

In the full-color image forming apparatus 100, a surface of the image holder 101*a* is uniformly charged by a charging device 102*a* as the image holder 101*a* rotates in a direction of an arrow mark C. Thereafter, an electrostatic latent image of the first color is formed on a surface of the image holder 101*a* by use of an exposing device 114*a* such as laser light. The formed electrostatic latent image is developed with a toner (visualized) by a developing device 103*a* accommodating the toner corresponding to a first color to form the toner image having the first color. Each of the developing devices 103*a* through 103*d* stores a toner corresponding to an electrostatic latent image of each of the colors (such as yellow, magenta, cyan or black).

A toner image formed on the image holder 101*a* is electrostatically transferred by a first transfer roll 105*a* on the intermediate transfer belt 107 when going past the first transfer portion (first transferring). Thereafter, on the intermediate transfer belt 107 holding the toner image of the first color a toner image of the second color, a toner image of the third color and a toner image of the fourth color are sequentially first transferred by use of first transfer rolls 105*b* through 105*d* so as to superpose to finally obtain a full-color multi-toner image.

The multi-toner image formed on the intermediate transfer belt 107 is electrostatically collectively transferred on the transfer receiver medium 115 when going past the second transfer portion. The transfer receiver medium 115 on which the multi-toner image is transferred is conveyed to the fusing device 110 to subject to the fusing under heating and/or pressure, followed by being discharged outside of the image forming apparatus 100.

By use of the image holder cleaning devices 104*a* through 104*d*, residual toners are removed from the image holders 101*a* through 101*d* after the first transferring. On the other hand, residual toners are removed from the intermediate transfer belt 107 after the second transferring by use of the intermediate transfer belt cleaning devices 112 and 113. Thus, the image forming apparatus 100 is made ready for a next image forming process.

Intermediate Transfer Belt

Content of Carbon Black in Intermediate Transfer Belt

In the exemplary embodiment, the intermediate transfer belt 107 has at least two layers of the outermost periphery layer and the innermost periphery layer. A content of carbon black contained per unit volume of the outermost periphery layer is smaller than a content of carbon black contained per unit volume of the innermost periphery layer.

When the content of carbon black contained in the outermost periphery layer is controlled so as to be smaller than that of carbon black contained in the innermost periphery layer, appearing of fine white spots on an output image may be suppressed. That is, in a first transfer member which is in contact with an inner surface side of the intermediate transfer belt 107 in the first transfer means (that is, first transfer rolls 105*a* through 105*d*) and a second transfer member which is in contact with an inner surface side of the intermediate transfer belt 107 in the second transfer means (that is, backup roll 108), electrons flow into the intermediate transfer belt 107. The flowed-in electrons reach an outer periphery surface of the intermediate transfer belt 107. It is expected that an increase in a discharge current can be suppressed and thereby generation of the fine white spots are suppressed since an amount of electrons can be controlled due to having the above configuration in the exemplary embodiment of the invention.

While the mechanism thereof is unclear, it is assumed as follows. That is, charge transfer from the inner surface side of the intermediate transfer belt is changed depending on the difference between a dispersion state of the carbon black in the outermost periphery layer and that of the innermost periphery layer. Further, since the content of carbon black in the outermost periphery layer is smaller, the charge transfer therein becomes slower to result in less affection of discharge at the outer periphery surface, and thereby, increase of the discharge current is assumed to be suppressed.

From the viewpoint of more effectively suppressing generation of the fine white spots, a ratio (A/B) of a content A (% by weight) of the carbon black contained per unit volume in the outermost periphery layer to the content B (% by weight) of carbon black contained per unit volume in the inner most periphery layer is preferably in the range of about 0.78 to about 0.99, more preferably in the range of about 0.80 to about 0.97, still more preferably in the range of about 0.81 to about 0.92 and particularly preferably in the range of about 0.83 to about 0.90.

When the ratio (A/B) is set at about 0.78 or more, deterioration of the granularity due to the scattering of the toner to the periphery without being transferred to a predetermined position due to the disturbance of the transfer electric field can be excellently suppressed when the toner is transferred in the first transferring and second transferring. On the other hand, when the ratio (A/B) is set at about 0.99 or less, generation of the fine white spots can be suppressed since an amount of electrons which reach an outer periphery surface of the intermediate transfer belt 107 due to the transfer voltage can be sufficiently controlled in the first transferring and second transferring.

Film Thicknesses of Outermost Layer and Innermost Layer of Intermediate Transfer Belt Furthermore, in the exemplary embodiment, the intermediate transfer belt 107 preferably satisfies the following Inequality (1).

$$50 \leqq du/(du+dl) \times 100 \leqq 80 \qquad \text{Inequality (1)}$$

In Inequality (1), du denotes a film thickness (μm) of the outermost periphery layer, and dl denotes a film thickness (μm) of the innermost periphery layer.

Herein, in the second transferring, electrons from the second transfer member (that is, backup roll 108), which is in contact with the inner surface side of the intermediate transfer belt 107, are injected into the outermost periphery layer. When a content of carbon black in the outermost periphery layer is small like that in the exemplary embodiment, electrons are locally stored in the outermost periphery layer of the intermediate transfer belt 107 to generate a local electric field. When the electric field intensity of the local electric field exceeds a threshold value, charges flow at a burst to the outer periphery surface of the intermediate transfer belt 107 to cause discharge at a space between the intermediate transfer belt 107 and the second transfer roll 109. The inventors have found that regions where toner images on the output image are absent (HT unevenness) can be generated since the toner in the discharge region is charged to an opposite polarity so as not to be transferred to the transfer receiver medium.

When Inequality (1) is satisfied, generation of the HT unevenness can be suppressed. That is, when the ratio of the film thickness of the outermost periphery layer (du) and the film thickness of the innermost periphery layer (dl) is controlled in the range of du/(du+dl)×100≦80, an amount of electrons stored inside of the outermost periphery layer can be suppressed, an amount of electrons flowing at a burst to the outer periphery surface of the intermediate transfer belt 107 can be suppressed, and thereby generation of the HT unevenness can be suppressed.

Further, when Inequality (1) is satisfied, generation of the fine white spots can be suppressed. That is, when a ratio of a film thickness of the outermost periphery layer (du) and a film thickness of the innermost periphery layer (dl) is controlled in the range of 50≦du/(du+dl)×100, an amounts of electrons that reach the outer periphery surface of the intermediate transfer belt 107 after flowing into the intermediate transfer belt 107 can be controlled, an increase of discharge current can be suppressed, and thereby generation of the fine white spots can be suppressed.

Furthermore, when Inequality (1) is satisfied, a transfer electric field which is necessary and sufficient for a transfer gap can be formed in the first transferring and second transferring so that the transfer defect due to the deficiency of the transfer electric field (density lowering) can be suppressed, and thereby an excellent output image can be obtained.

A ratio of the film thickness of the outermost periphery layer (du) and the film thickness of the innermost periphery layer (dl) more preferably satisfies 55≦du/(du+dl)×100≦78) (Inequality (4)), still more preferably satisfies 60≦du/(du+dl)×100≦76) (Inequality (5)), and particularly preferably satisfies 63≦du/(du+dl)×100≦73) (Inequality (6)).

The intermediate transfer belt 107 in the exemplary embodiment preferably has a total film thickness from about 50 to about 130 μm. When the total film thickness is about 50 μm or more, sufficient mechanical strength can be retained and, a more excellent output image can be also obtained even in a long term use in an image forming apparatus. On the other hand, when the total film thickness is about 130 μm or less, sufficient flexibility can be retained and, a more excellent output image is also obtained without forming a stretching mark thereon even in a state of being stretched for a long term in the image forming apparatus.

Examples of a material of the intermediate transfer belt 107 include ones obtained by dissolving or dispersing a conductive agent in a thermoplastic resin such as a polycarbonate resin, a polyfluorinated vinylidene resin, a polyalkylene phthalate resin, a blend of polycarbonate/polyalkylene phthalate or an ethylene tetrafluoroethylene copolymer or a thermosetting resin such as polyimide or a copolymer of polyimide and polyamide.

Carbon black is contained as a conductive agent in each of the outermost periphery layer and innermost periphery layer of the intermediate transfer belt of the exemplary embodiment. While any known carbon blacks can be used as the carbon black, carbon black having an oxidized surface can be preferably used.

When the intermediate transfer belt 107 of the exemplary embodiment has other intermediate layer, the other intermediate layer may preferably contain carbon black as a conductive agent.

Figure 2:
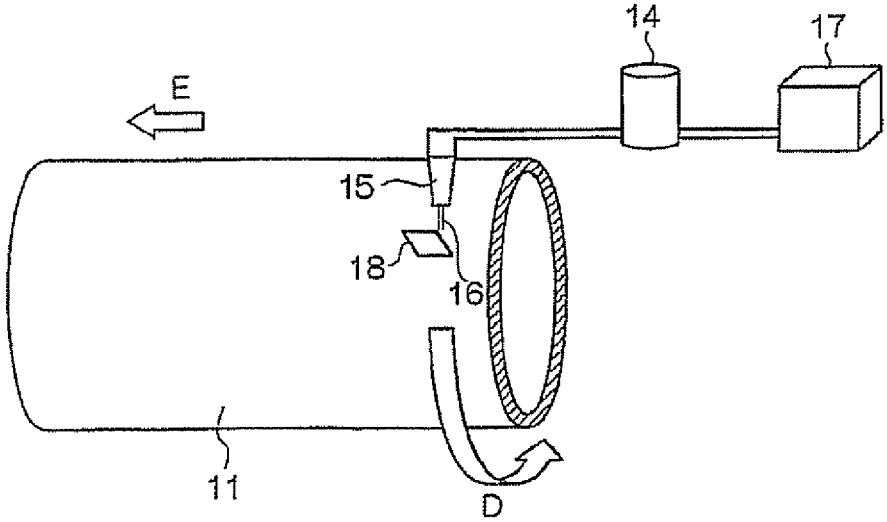
FIG. 2 is a schematic sectional diagram illustrating an example of an apparatus for coating of a surface of an innermost periphery layer of a cylinder-molded tube used for forming the intermediate transfer belt according to one exemplary embodiment of the invention.

A method of producing the intermediate transfer belt 107 involving the exemplary embodiment is not particularly restricted. For example, the intermediate transfer belt 107 can be preferably manufactured by a rotary coating method such as shown in FIG. 2 with a polyimide precursor liquid.

In the rotary coating method, a cylinder-molded tube 11 having an outer diameter corresponding to a length of the intermediate transfer belt 107 is prepared. A nozzle 15 for discharging a coating solution 16 on an outer periphery surface of the cylinder-molded tube 11 is disposed at a position along an outer periphery surface of the cylinder-molded tube 11. The nozzle 15 is connected via a piping to a coating solution container 14. The coating solution container 14 is connected via a piping to a pressure device 17. Further, under the nozzle 15, a blade 18 for leveling the discharged coating solution 16 on the outer periphery surface of the cylinder-molded tube 11 is disposed.

The cylinder-molded tube 11 is rotated in a direction of a rotation direction of the cylinder-molded tube (an arrow mark D) to discharge the coating solution (the innermost periphery layer coating solution) 16 from the nozzle 15 onto an outer periphery surface of the cylinder-molded tube 11, and the discharged coating solution 16 is leveled by use of the blade 18 on the outer periphery surface of the cylinder-molded tube 11. The nozzle 15 and blade 18 move at a constant speed in a direction (an arrow mark E) where the nozzle 15 and blade 18 move to apply the coating solution 16 onto the outer periphery surface of the cylinder-molded tube 11 so that the thickness of the layer formed by the solution 16 becomes constant. Herein, control is performed by use of a pressure device 17 so that a constant amount of the coating solution 16 may be discharged from the nozzle 15. Thereby, a film formed of the coating solution 16 is provided on the outer periphery surface of the cylinder-molded tube 11.

A film having a desired configuration may be obtained by repeating coating the coating solution 16 as an outermost periphery layer coating solution onto an innermost periphery layer and drying thereof after forming the innermost periphery layer by heating and drying the above-obtained film. Thereafter, the film having the configuration is peeled off the cylinder-molded tube 11 after cooling, followed by cutting in a predetermined width, and thereby an intermediate transfer belt 107 may be obtained.

When a polyimide precursor is used as a resin material of the coating solution 16 (namely, the innermost periphery layer coating solution and the outermost periphery layer coating solution), the coating solution 16 can be applied on an outer periphery surface of the cylinder-molded tube 11 to form a coating solution film, followed by drying the coating solution film at a temperature from 80 to 170° C. to remove a solvent in the coating solution (drying process), further followed by heating the dried film at a temperature from about 250 to about 350° C. to imidize the polyimide precursor (calcining process) to form a polyimide resin film. In the exemplary embodiment, a film having a desired configuration may be obtained by forming the innermost periphery layer and the outermost periphery layer (namely, by repeating coating and drying) and further performing calcining.

In the case where the film to be obtained has a configuration with three or more layers, the film can be formed by repeating the coating and drying processes.

A concentration of solid content of the coating solution 16 is can be, for example, in the range of about 10 to % to about 40% by weight, and the viscosity thereof can be, for example, in the range of about 1 Pa·s to about 100 Pa·s. A certain amount of conductive particles such as carbon black may be dispersed in the coating solution 16 in accordance with a required surface resistivity of the intermediate transfer belt. Examples of a method of dispersing the conductive particles include known methods using a jet mill, a roll mill, a ball mill, a vibration ball mill, an attritor, a sand mill, a colloid mill or a paint shaker.

A thickness of the intermediate transfer belt 107 may be controlled through a discharging amount of the coating solution 16, a traveling speed of the nozzle 15 and blade 18, and/or a concentration of solid content of the coating solution 16. The thickness of the intermediate transfer belt 107 is preferably from about 50 μm to about 130 μm from the viewpoint of maintaining the dimensional accuracy even when the image output is repeated.

Image Holder

Any known electrophotographic photoreceptor may be applied as the image holders 101*a* through 101*d*. Examples of the electrophotographic photoreceptor include an inorganic photoreceptor of which photosensitive layer is formed of an inorganic material and an organic photoreceptor of which photosensitive layer is formed of an organic material. Examples of the organic photoreceptors include: a function-separated organic photoreceptor where a charge generating layer that generates electric charges upon exposure and a charge transportation layer that transports charges; and a single-layer organic photoreceptor where one layer generates charges and transports the charges. Furthermore, examples of the inorganic photoreceptor include one where a photosensitive layer is constituted of amorphous silicon.

A shape of the image holder is not particularly restricted. Examples of the shape of the image holder include known shapes such as a cylindrical drum, a sheet or a plate.

Charging Device

The charging devices 102*a* through 102*d* are not particularly restricted. Known charging devices such as: a contact charging device that uses a conductive or semi-conductive roller, brush, film or rubber plate; a scorotron charging device; or a corotron charging device that makes use of corona discharge may be widely used. (Herein, "conductivity" means the volume resistivity of less than about $10^7$ Ω·cm unless otherwise stated. Further, the "semi-conductivity" herein means the volume resistivity from about $10^7$ Ω·cm to about $10^{13}$ Ω·cm unless otherwise stated.) Among these, the contact charging device is preferred since it may generate less ozone and may perform efficient charging.

The charging devices 102*a* through 102*d* normally apply a DC current to the image holders 101*a* through 101*d*. The charging devices 102*a* through 102*d* may further superpose an AC current to the image holders 101*a* through 101*d*.

Exposing Device

The exposing devices 114*a* through 114*d* are not particularly restricted. Any known exposing device such as a light source (such as semiconductor laser light, LED light or liquid crystal shutter light) or an optical instrument, that may expose imagewise in a desired manner through a polygon mirror from a light source, may be widely used for exposing surfaces of the image holders 101*a* through 101*d*.

Developing Device

The developing devices 103*a* through 103*d* may be selected in accordance with the object. Examples thereof include a known developing device which performs development by providing a single-component developing agent or a two-component developing agent to an image holder in a contacting or non-contacting manner by use of a brush or a roller.

A configuration of a toner (developing agent) used in an image-forming apparatus 100 of the exemplary embodiment is not particularly restricted. Examples thereof include a toner containing at least a binder resin and a coloring agent.

Examples of the binder resin include homopolymers and copolymers of styrenes, monoolefins, vinyl esters, α-methylene aliphatic monocarboxylic acid esters, vinyl ethers and/or vinyl ketones. Examples of particularly representative binder resins include polystyrene, a styrene-alkyl acrylate copolymer, a styrene-alkyl methacrylate copolymer, a styrene-acrylonitrile copolymer, a styrene-butadiene copolymer, a styrene-maleic anhydride copolymer, polyethylene and polypropylene. Examples thereof further include polyester, polyurethane, an epoxy resin, a silicone resin, polyamide, modified rosin and paraffin wax.

Examples of the coloring agent included magnetic powders such as magnetite or ferrite, carbon black, aniline blue, calcoil blue, chrome yellow, ultramarine blue, DuPont oil red, quinoline yellow, methylene blue chloride, phthalocyanine blue, malachite green oxalate, lamp black, rose bengal, C.I. pigment red 48:1, C.I. pigment red 122, C.I. pigment red 57:1, C.I. pigment yellow 97, C.I. pigment yellow 17, C.I. pigment blue 15:1, and C.I. pigment blue 15:3.

Known additive agents such as a charge controlling agent, a mold releasing agent, and/or particles other than the conductive particles may be added to the toner internally or externally.

Examples of the mold releasing agent include low molecular polyethylene, low molecular polypropylene, Fischer-Tropsch wax, montan wax, carnauba wax, rice wax and candelilla wax.

As the charge controlling agent, known ones may be used. Examples thereof include azo metal complex compounds, salicylate metal complexes, and resin charge controlling agents containing a polar group.

Fine inorganic particles having an average primary particle diameter of 40 μm or less may be used as the other particles in order to control the powder fluidity and charge controlling of the toner. Further, as needs arise, inorganic particles or organic particles having particle diameters larger than those of the fine inorganic particles may be used together in order to reduce the adherence. Known particles may be used as the other particles.

It may be effective to subject the fine inorganic particles to a surface treatment in view of improving the dispersibility and powder fluidity of the fine inorganic particles.

Examples of a method of producing the toner which are preferable from the viewpoint of obtaining high shape controllability include polymerization methods such as an emulsion-polymerization flocculation method or a dissolution suspension method. Further, a method including providing the toner obtained by any of these methods as cores, adhering flocculating particles to the cores, and heating and fusing so as to impart a core-shell structure to the toner may be adopted.

Examples of a method for adding the external additive to the toner include a method where the toner and the external additive are mixed by use of a Henschel mixer or a V-blender. Further, when the toner is manufactured by use of a wet process, the external additive may be added in the wet process to the toner.

First Transfer Roll

The first transfer rolls 105*a* through 105*d* may have either a single-layer structure or a multi-layer structure. For example, when the first transfer roll has a single-layer structure, the first transfer roll can be formed by appropriately blending conductive particles such as carbon black in foamed or non-foamed silicon rubber, urethane rubber or EPDM.

Alternatively, a roll having a surface which is made of metal may be used as the first transfer rolls 105*a* through 105*d*. The first transfer roll having a surface which is made of metal is preferable from the viewpoints of excellent resistance to environmental variation, the roll resistance suppressed from going up with time, power source capacity and the controllability of a current value.

In this regard, image defects of fine white spots tend to occur due to an increase in a discharge current when a roll having a surface which is made of metal is used as the first transfer roll under conventional conditions.

On the other hand, when the intermediate transfer belt 107 involving the exemplary embodiment is applied, generation of the fine white spots are suppressed even when first transfer rolls 105*a* through 105*d* respectively have a surface which is made of metal.

Examples of a metal that forms a surface of each of the first transfer rolls 105*a* through 105*d* include known metals such as stainless steel, iron and aluminum. Preferable examples thereof include those obtained by applying plating of nickel, copper or chromium on a surface of the metal.

Device for Cleaning Image Holder

The image holder cleaning devices 104*a* through 104*d* are used to remove the toner adhering and remaining on a surface of each of the image holders 101*a* through 101*d* after the first transferring. A cleaning blade, a cleaning brush, and/or a cleaning roll may be used as the image holder cleaning device. Among these, the cleaning blade can be preferably used. Examples of a material of the cleaning blade include urethane rubber, neoprene rubber and silicone rubber.

Second Transfer Roll

A layer structure of the second transfer roll 109 is not particularly restricted. For example, when the second transfer roll 109 has a three-layered structure, the structure may have a core layer, an intermediate layer and a coating layer covering a surface of the second transfer roll. The core layer may contain a foamed body such as that formed of silicone rubber, urethane rubber or EPDM in which conductive particles are dispersed, and the intermediate layer may contain a non-foamed body of any one of these. Examples of a material of the coating layer include a tetrafluoroethylene-hexafluoropropylene copolymer and a perfluoroalcoxy resin. The volume resistivity of the second transfer roll 109 is preferably about $10^7$ Ω·cm or less. The layer structure of the second transfer roll 109 may be a two-layer structure obtained by removing the intermediate layer from the configuration of the three-layered structure.

Backup Roll

The backup roll 108 forms a counter electrode of the second transfer roll 109. A layer structure of the backup roll 108 may be either a single layer or a multi-layer. For example, when the backup roll 108 has a single layer structure, the single layer structure may be formed by appropriately blending conductive particles such as carbon black in silicone rubber, urethane rubber or EPDM. When the backup roll 108 is formed into a two-layer structure, the structure may be formed of a roll having an outer periphery surface of an elastic layer constituted of a rubber material such as mentioned above being covered with a layer having high resistivity.

Alternatively, a roll having a surface which is made of metal may be used as the backup roll 108. The backup roll having a surface which is made of metal is preferable from the viewpoints of excellent resistance to environmental variation, the roll resistance suppressed from going up with time, power source capacity and the controllability of a current value.

In this regard, image defects of fine white spots tend to occur due to an increase in a discharge current when a roll having a surface which is made of metal is used as the backup roll under conventional conditions.

On the other hand, when the intermediate transfer belt 107 involving the exemplary embodiment is applied, generation of the fine white spots are suppressed even when the backup roll 108 has a surface which is made of metal.

Examples of a metal that forms a surface of the backup roll 108 include known metals such as stainless steel, iron and aluminum. Preferable examples thereof include those obtained by applying plating of nickel, copper or chromium on a surface of the metal.

A voltage from 1 to 6 kV can be usually applied between a shaft of the backup roll 108 and a shaft of the second transfer roll 109. In place of application of voltage to the shaft of the backup roll 108, a voltage may be applied between an electroconductive electrode member which is brought into contact with the backup roll 108 and the second transfer roll 109. Examples of the electrode member include a metal roll, a conductive rubber roll, a conductive brush, a metal plate and a conductive resin plate.

Fixing Device

Examples of fixing devices 110 include known fixing devices such as a hot roll fixing device, a pressure roll fixing device and a flash fixing device.

Device for Cleaning Intermediate Belt

A cleaning blade, a cleaning brush, and/or a cleaning roll may be used as the intermediate transfer belt cleaning devices 112 and 113. Among these, the cleaning blade can be preferably used. Examples of a material of the cleaning blade include urethane rubber, neoprene rubber and silicone rubber.

Positional Relationship Between Image Holder and First Transfer Roll

Figure 3:
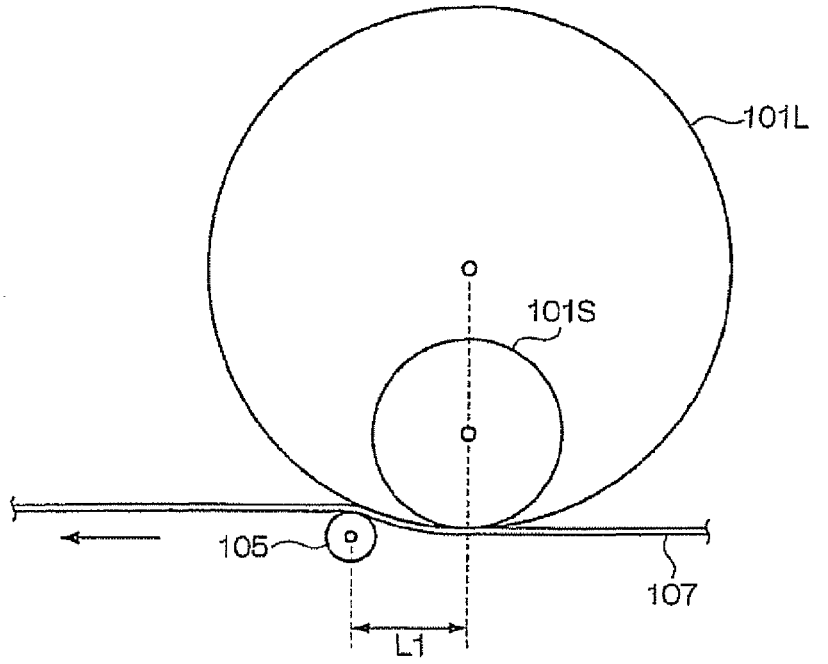
FIG. 3 RELATED ART
FIG. 3 is a schematic diagram illustrating an example of a positional relationship of an image holder and a first transfer roll in related art.

When an image holder 101S having a small diameter is used as shown in FIG. 3, the intermediate transfer belt 107 is disposed between the image holder 101S and the first transfer roll 105, and thus the image holder 101S and the first transfer roll 105 do not come into direct contact. However, as a processing speed of an image forming apparatus becomes higher, a diameter of an image holder 101L becomes larger and a curvature radius thereof becomes smaller. In that case, the image holder 101L may come into direct contact with the first transfer roll 105 (via the intermediate transfer belt 107). In particular, when a surface of the first transfer roll 105 is made of a metal, a contact between the image holder 101L and the first transfer roll 105 becomes a contact between rigid bodies. It is found by the inventors that when the first transfer roll 105 having a metallic surface is used for a long period, a surface of the image holder 101L can be scratched due to inclusion of foreign matters such as carrier, and thereby colored spots can be generated on an output image.

Figure 4:
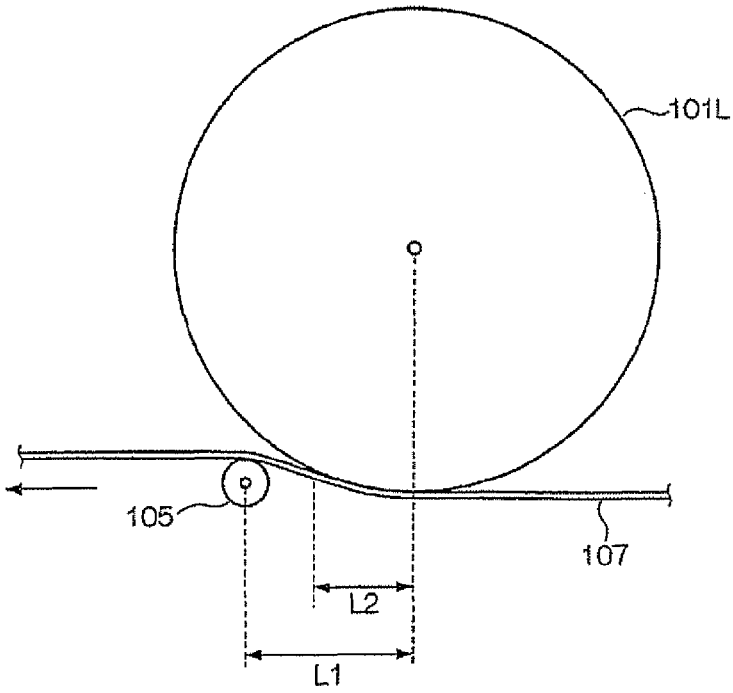
FIG. 4 is a schematic diagram illustrating a preferable example of a positional relationship of an image holder and a first transfer roll in one exemplary embodiment of the invention.

In the exemplary embodiment, as shown in FIG. 4, an offset distance L1 (a distance of a misalignment between an axis of the image holder 101L and an axis of the first transfer roll 105 in a drive direction of the intermediate transfer belt 101) may be larger than a absorption distance L2 of the intermediate transfer belt (a length of a region where the intermediate transfer belt 107 is in contact with the image holder 101L).

The absorption distance L2 of the intermediate transfer belt depends on a diameter of the image holder 101L. The larger a diameter of the image holder 101L is, the larger the absorption distance L2 becomes. Further, the smaller the tension of the intermediate transfer belt 107 is, the larger the load of the first transfer roll 105 is, and the nearer the first transfer roll 105 is to the image holder 101L, the larger the absorption distance L2 of the intermediate transfer belt becomes. When the first transfer roll 105 is disposed as shown in the configuration, irrespective of the diameter of the image holder 101L, the first transfer roll 105 does not come into direct contact with the image holder 101L. Accordingly, even after a long use, scratches on a surface of the image holder 101L can be suppressed.

When, the offset distance L1 is set larger as shown in FIG. 4 and the load of the first transfer roll 105 is lowered, a transfer voltage may become larger to increase a discharge current, thereby fine white spots tend to occur. On the other hand, when the intermediate transfer belt 107 involving the exemplary embodiment is applied, generation of the fine white spots may be suppressed.

While a so-called tandem image forming apparatus constituted of a plurality of image holders was described in the foregoing exemplary embodiment, the image forming apparatus may be a so-called plural cycles apparatus (such as four-cycles system), in which one image holder is provided and an intermediate transfer belt carries out a rotation/image formation process by the number of colors to be formed.

EXAMPLES

Hereinafter, exemplary embodiments of the invention will be specifically described with reference to examples and comparative examples, while it should be understood that the invention is not limited to these examples.

Example 1

Preparation of Intermediate Transfer Belt

Preparation of Carbon Black-Dispersed Polyimide Precursor Liquid for Innermost Periphery Layer In the beginning, carbon black (trade name: SPECIAL BLACK 4, manufactured by Degussa) is added to a n-methyl-2-pyrrolidone (NMP) solution of polyamic acid made from 3,3',4,4'-biphenyl tetracarboxylic dianhydride and 4,4'-diaminodiphenyl ether (a solid content rate after imidization: 18% by weight), so that a content of carbon black becomes 80 parts by weight with respect to 100 parts by weight of a solid content of polyamic acid, followed by dispersing and mixing by use of a jet mill dispersing unit (trade name: GEANUS PY (the minimum cross-sectional area of a colliding portion: 0.032 $mm^2$), manufactured by Geanus Co., Ltd.) by passing through a dispersing unit portion 5 times under pressure of 200 MPa, thereby a dispersion (A) is obtained.

Then, a NMP solution of polyamic acid made from 3,3',4,4'-biphenyl tetracarboxylic dianhydride and 4,4'-diaminodiphenyl ether (a solid content rate after imidization is 18% by weight) is added to the obtained dispersion (A) so that a content of carbon black becomes 22 parts by weight with respect to 100 parts by weight of polyamic acid, followed by mixing and agitating by use of a planetary mixer (trade name: G-AIKO MIXER, manufactured by Aikosha Seisakusho), thereby a carbon black-dispersed polyimide precursor liquid for the innermost periphery layer is prepared.

Preparation of Carbon Black-Dispersed Polyimide Precursor Liquid for Outermost Periphery Layer In the next place, a carbon black-dispersed polyimide precursor liquid of the outermost periphery layer is prepared in the similar method used in the preparation of the carbon black-dispersed polyimide precursor liquid for the innermost periphery layer, except that, a NMP solution of polyamic acid made from 3,3',4,4'-biphenyl tetracarboxylic dianhydride and 4,4'-diaminodiphenyl ether (a solid content rate after imidization is 18% by weight) is added to the dispersion (A) so that carbon black becomes 16 parts by weight with respect to 100 parts by weight of polyamic acid.

Formation of Innermost Periphery Layer

As a cylinder-molded tube 11 shown in FIG. 2, an aluminum cylinder having an outer diameter of 366 mm and a length of 650 mm is prepared. The aluminum cylinder has been, subjected to surface grinding to have an outer diameter of 366 mm and then surface roughened by means of blasting with spherical glass particles so that the surface roughness Ra may be 0.40 μm. A silicone mold releaser (trade name: KS700, manufactured by Shin-Etsu Chemical Co., Ltd.) is coated on a surface of the cylinder-molded tube 11, followed by baking at 300° C. for 1 hr so as to provide an aluminum cylinder. Further, as shown in FIG. 2, the cylinder-molded tube 11 is rotated at 40 rpm in a direction of an arrow mark D with having an axial direction of the cylinder-molded tube 11 being horizontal (rotary coating). A blade 18 is made of stainless steel, has a width of 20 mm and a thickness of 0.5 mm, and has elasticity. As the polyimide precursor liquid 16, the carbon black-dispersed polyimide precursor liquid for the innermost periphery layer is coated onto the cylinder-molded tube 11 by being extruded from a container 14 through a nozzle 15 having an aperture of 2 mm while having the blade 18 pressed against the cylinder-molded tube 11. When the polyimide precursor liquid 16 goes past the blade 18, the blade 18 is expanded to form a gap between the blade 18 and the cylinder-molded tube 11. Then, the nozzle 15 and blade 18 are moved in a direction of an arrow mark E at a speed of 120 mm/min. Upon the coating, 20 mm of an uncoated region is disposed at each of both ends of the cylinder-molded tube 11. Next, the cylinder-molded tube 11 on which the carbon black-dispersed polyimide precursor liquid for the innermost periphery layer is coated is heated and dried at 120° C. for 25 min while being kept in the horizontal state and rotating at 6 rpm so as to provide a dry film of the carbon black-dispersed polyimide precursor for the innermost periphery layer. A film thickness of the carbon black-dispersed polyimide precursor for the innermost periphery layer is controlled by controlling an amount of the liquid extruded from the nozzle 15 at the time of the coating so that a film thickness of the coated film after imidization becomes 53 μm.

Formation of the Outermost Periphery Layer

The carbon black-dispersed polyimide precursor liquid for outermost periphery layer is coated on a surface of the cylinder-molded tube 11 on which the dry film of the carbon black-dispersed polyimide precursor for innermost periphery layer is formed in the same manner as the method for forming the innermost periphery layer.

Next, the cylinder-molded tube 11 on which the carbon black-dispersed polyimide precursor liquid for the outermost periphery layer is coated is heated and dried at 120° C. for 25 min while being kept in the horizontal state and rotating at 6 rpm so as to provide a dry film of the carbon black-dispersed polyimide precursor for the outermost periphery layer. A film thickness of the carbon black-dispersed polyimide precursor for the outermost periphery layer is controlled by controlling an amount of the liquid extruded from the nozzle 15 at the time of the coating so that a film thickness of the coated film after imidization becomes 47 μm.

The obtained cylinder-molded tube 11 having a dry film of the carbon black-dispersed polyimide precursor for the outermost periphery layer provided on an obtained dry film of the carbon black-dispersed polyimide precursor for the innermost periphery layer is heated at 200° C. for 30 min, further heated at 260° C. for 30 min, furthermore heated at 300° C. for 30 min, and finally heated at 320° C. for 20 min to form a film of carbon black-dispersed polyimide. Thereafter, after cooling the cylinder-molded tube 11 to room temperature (25° C.), the polyimide resin film is peeled off the cylinder-molded tube 11. The thus-obtained polyimide resin film is cut at a width of 362 mm to provide an intermediate transfer belt piece. Two intermediate transfer belt pieces are connected to provide an intermediate transfer belt having a perimeter of 2111 mm.

A surface resistivity of the intermediate transfer belt is 12.02 Log Ω/□ and a volume resistivity of the intermediate transfer belt is 11.72 Log Ω·cm. The surface resistivity and the volume resistivity are obtained by measuring values of these parameters at 80 portions, which are coordinated by 20 points varied with respect to a process direction of the intermediate transfer belt and 4 points varied with respect to a direction perpendicular to the process direction, and then averaging the measured values.

Examples 2 to 40 and Comparative Examples 1 to 6

Intermediate transfer belts of Examples 2 to 40 and comparative examples 1 to 6 are prepared in the same manner as the method for forming the intermediate transfer belt of Example 1, except that the outermost periphery layer film thickness (du), the innermost periphery layer film thickness (dl), a content of carbon black (CB) in the outermost periphery layer and a content of carbon black (CB) in the innermost periphery layer are respectively changed to values shown in Table 1 or Table 2. The surface resistivity and the volume resistivity of each of the intermediate transfer belts are shown in Table 1 and Table 2.

Measurement of Surface Resistivity ρs

Figure 5:
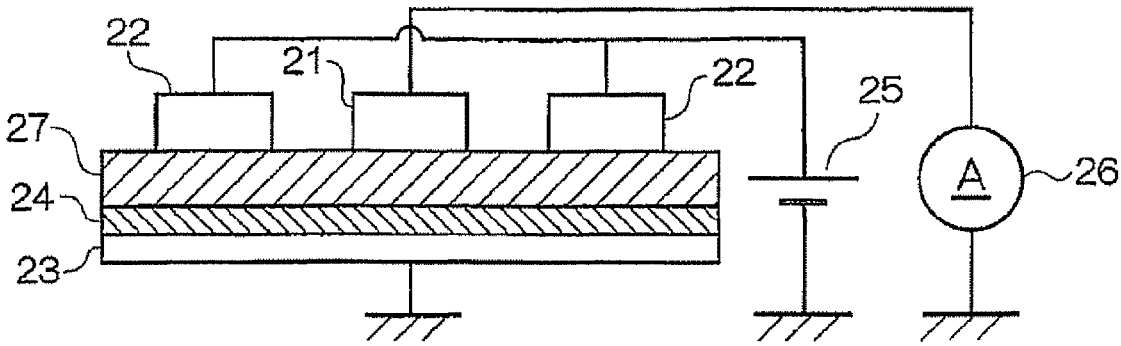
FIG. 5 is a schematic sectional diagram illustrating an example of a surface resistivity meter for measuring surface resistivity of the intermediate transfer belt in one exemplary embodiment of the invention.

A sectional schematic diagram of a surface resistivity meter is shown in FIG. 5. An insulating sheet 24 is disposed on a back surface electrode 23 connected to GND, and a measurement sample 27 is disposed on the insulating sheet 24. A front surface electrode 21 and a guard electrode 22 are disposed on the measurement sample 27 to form a sandwich structure where the measurement sample 27 is disposed between the back surface electrode 23 and the front surface electrode 21 and the guard electrode 22 via the insulating sheet 24. The surface resistivity of the measurement sample 27 is obtained by applying a DC voltage by a direct current (DC) power supply 25 connected to the guard electrode 22, and measuring a flowing current amount by use of a micro-current meter 26 connected to the surface electrode 21 so as to calculating the surface resistivity therefrom.

Figure 7:
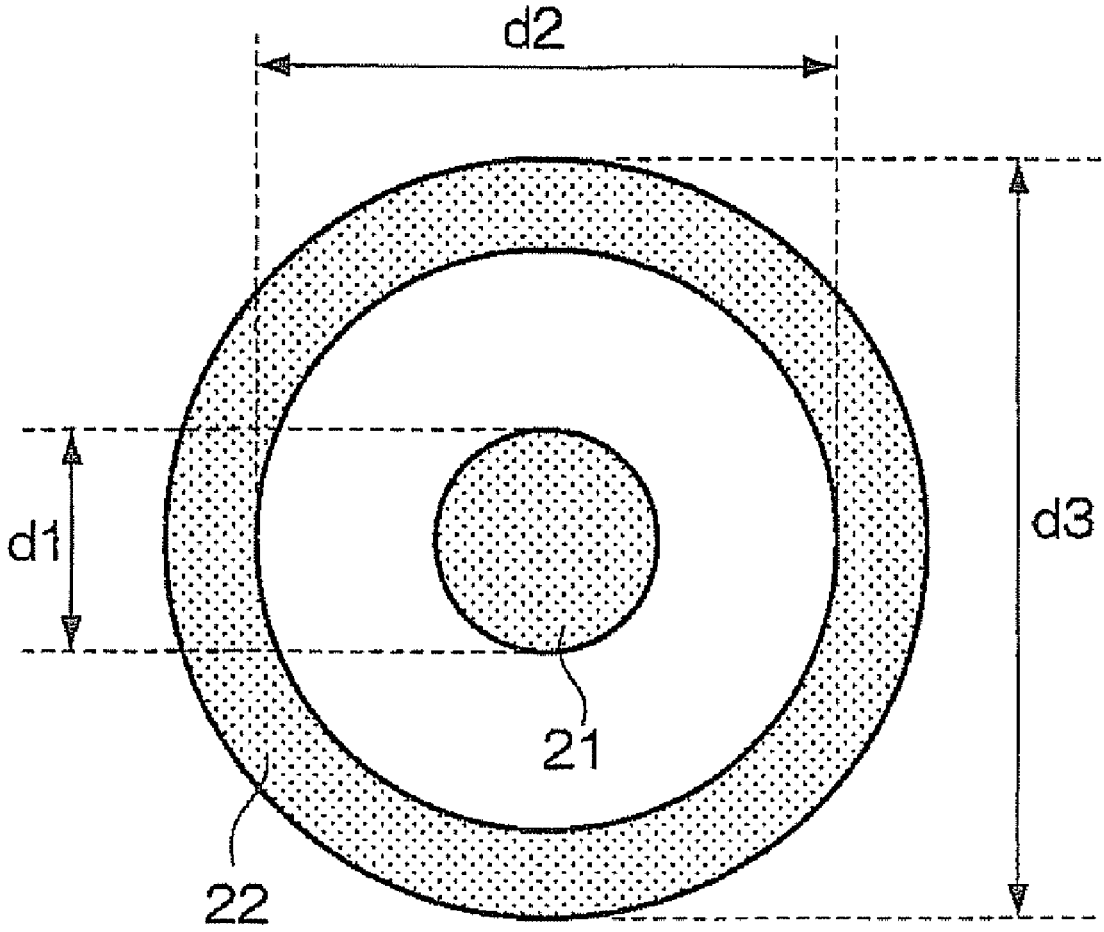
FIG. 7 is a schematic plan view of an electrode used in a surface resistivity meter and a volume resistivity meter for measuring surface resistivity and volume resistivity of the intermediate transfer belt in one exemplary embodiment of the invention.

FIG. 7 shows a schematic plan view of an electrode used in a surface resistivity meter. A guard electrode 22 is disposed concentric annularly with disposing a surface electrode 21 at the center. Herein, d1 through d3 respectively express a diameter of a central electrode 21, a diameter of an inner periphery circle of the guard electrode 22 and a diameter of an outer periphery circle of the guard electrode 22. The values may be arbitrarily set in accordance with a magnitude and a shape of the measurement sample. In the measurement of the surface resistivity of the Examples, an UR PROBE (trade name, manufactured by Mitsubishi Chemical Co., Ltd.) is used and d1 through d3 are respectively set to the following values.

d1=16 mm d2=30 mm d3=40 mm

The surface resistivity ρs is calculated by the following Equation (2) below, $$\rho s=[\pi(d2+d1)/(d2-d1)]\times(V/I) \quad (2)$$

In Equation (2), V expresses a voltage value (V) applied to the central electrode 21. I expresses a current value (A) detected by the micro-current meter 26. In the measurement of the surface resistivity in the Examples, a voltage applied to the central electrode 21 is set at 500 V. Further, a current value I is a value at 10 second after the voltage V is applied. The surface resistivity is measured under an environment of 20° C. and 40% relative humidity.

Measurement of Volume Resistivity ρv

Figure 6:
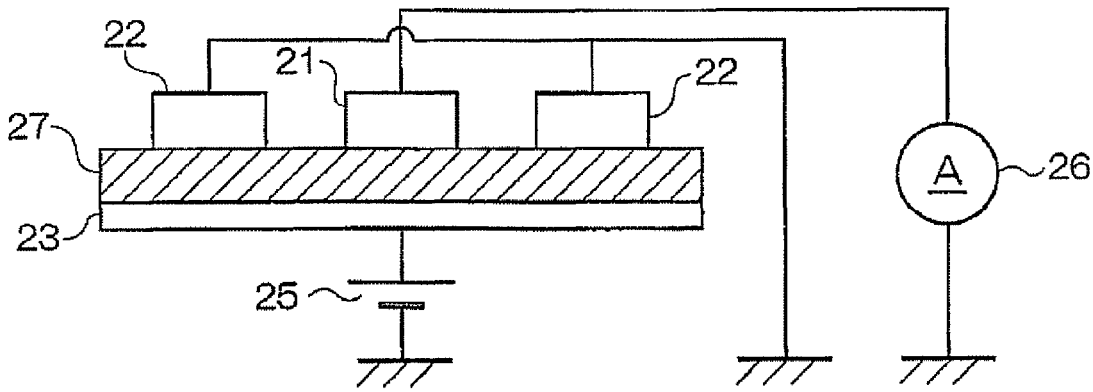
FIG. 6 is a schematic sectional diagram illustrating an example of a volume resistivity meter for measuring volume resistivity of the intermediate transfer belt in one exemplary embodiment of the invention.

FIG. 6 shows a sectional schematic diagram of a volume resistivity meter. A measurement sample 27 is disposed on a back surface electrode 23 connected via a DC power source 25 to GND. A front surface electrode 21 and a guard electrode 22 are disposed on the measurement sample 27 to form a sandwich structure where the measurement sample 27 is disposed between the back surface electrode 23 and the front surface electrode 21 and the guard electrode 22. The guard electrode 22 is connected to GND. The volume resistivity of the measurement sample 27 is obtained by applying a DC voltage by a direct current (DC) power source 25 connected to the back surface electrode 23, and measuring a flowing current amount by use of a micro-current meter 26 connected to the surface electrode 21 so as to calculating the volume resistivity therefrom.

FIG. 7 shows a schematic plan view of an electrode used in a volume resistivity meter. A guard electrode 22 is disposed concentric annularly with disposing a surface electrode 21 at the center. Herein, d1 through d3 respectively express a diameter of a central electrode 21, a diameter of an inner periphery circle of the guard electrode 22 and a diameter of an outer periphery circle of the guard electrode 22. The values may be arbitrarily set in accordance with a magnitude and a shape of the measurement sample. In the measurement of the volume resistivity in examples, an UR PROBE (trade name, manufactured by Mitsubishi Chemical Co., Ltd.) is used and d1 through d3 are respectively set to the following values.

d1=16 mm d2=30 mm d3=40 mm

The volume resistivity ρv is calculated from the following Equation (3)

$$\rho v=[(\pi\times d1^2)/4]\times(V/I)\times(1/t) \quad (3)$$

In Equation (3), V expresses a voltage value (V) applied to the central electrode 21. I expresses a current value (A) detected by the micro-current meter 26. t expresses a film thickness (cm) of the measurement sample. In the measurement of the volume resistivity in the Examples, a voltage applied to the central electrode 21 is set at 500 V. Further, a current value I is a value at 10 sec after the voltage V is applied. When a film thickness t of the measurement sample is measured, any one of known methods that use a micrometer or an eddy current film thickness meter may be preferably used. In the Examples, an eddy current film thickness meter (trade name: ISOSCOPE MP30, manufactured by Fischer Co., Ltd.) is used to the measurement. The volume resistivity is measured under an environment of 20° C. and 40% relative humidity.

Evaluation

The intermediate transfer belt of each of the Examples and the Comparative examples is mounted on an image evaluation unit. The image evaluation unit is prepared by modifying a color printer having a fundamental configuration shown in FIG. 1 (trade name: DOCUCOLOR 8000 DIGITAL PRESS, manufactured by Fuji Xerox Co., Ltd.) in such a manner that a second transfer roll is separated from a power source incorporated in an evaluation unit body and connected to an external power source (trade name: MODEL 610D, manufactured by Trek Co., Ltd.) to enable to apply a voltage directly from the outside to the second transfer roll. A transfer voltage applied to the second transfer roll during printing is set to 4.0 kV. The fine white spot, granularity and transfer defect are evaluated with respect to a cyan solid image (concentration: 100%) and the halftone unevenness (HT unevenness) is evaluated with respect to a cyan halftone image (concentration: 30%). Evaluation criteria are as shown below. Results thereof are shown in Tables 1 and 2.

Evaluation Grades of Fine White Spots:

G0: No fine white spot is generated.

G1: Slight generation of fine white spots is observed (within allowable level).

G2: Generation of fine white spots is observed (within allowable level).

G3: Generation of fine white spots is easily observed (within allowable level).

G4: Generation of fine white spots is observed and an allowable level is exceeded.

G5: Generation is remarkable and an allowable level is largely exceeded.

G6: Number and size of fine white spots become larger than an allowable level is exceeded to far extent.

Evaluation Grades of Granularity:

G0: No blurring of a dot is observed.

G1: Slight blurring of dots is observed (within an allowable level).

G2: Blurring of dots is observed (within an allowable level).

G3: Blurring of dots is easily observed (within an allowable level).

G4: Blurring of dots is at an allowable limit level.

G5: Blurring of dots becomes remarkable and largely exceeds an allowable level.

G6: Dot shape cannot be observed due to the blurring.

Evaluation Grades of Transfer Defect

G0: No lowering in density is observed.

G1: Slight lowering in density is observed (within an allowable level).

G2: Lowering in density is observed (within an allowable level).

G3: Lowering in density is easily observed (within an allowable level).

G4: Lowering in density is at an allowable limit level.

G5: Lowering in density becomes remarkable and far exceeds an allowable level.

G6: Owing to the lowering in density, a dot shape cannot be observed.

Evaluation Grades of HT Unevenness

G0: No HT unevenness is observed.

G1: Slight HT unevenness is observed (within allowable level).

G2: HT unevenness is observed (within allowable level).

G3: HT unevenness is easily observed (within allowable level).

G4: HT unevenness is observed and an allowable limit level.

G5: HT unevenness is remarkable and an allowable level is largely exceeded.

G6: Number and size of HT unevenness become larger than an allowable level is exceeded to far extent.

TABLE 1

| | | Film thickness (μm) | | | du/(du + dl) (%) | CB amount | | | Surface resistivity (Log Ω/□) | Volume resistivity (Log Ω · cm) | Image quality: Cyan 100% | | | Image quality: Cyan 30% |
|---|---|---|---|---|---|---|---|---|---|---|---|---|---|---|
| | ITB# | du | dl | du + dl | | OPL# (% by weight) | IPL# (% by weight) | OPL/IPL | | | Fine white spot | Granularity | Transfer defect | HT unevenness |
| Example 1 | 1 | 47 | 53 | 100 | 47 | 19.0 | 22.0 | 0.864 | 12.02 | 11.72 | 0 | 0 | 0 | 4 |
| Example 2 | 2 | 49 | 51 | 100 | 49 | 19.0 | 22.0 | 0.864 | 12.10 | 11.89 | 0 | 0 | 0 | 4 |
| Example 3 | 3 | 50 | 50 | 100 | 50 | 19.0 | 22.0 | 0.864 | 12.06 | 11.90 | 0 | 0 | 0 | 3 |
| Example 4 | 4 | 51 | 49 | 100 | 51 | 19.0 | 22.0 | 0.864 | 12.11 | 12.05 | 0 | 0 | 0 | 3 |
| Example 5 | 5 | 54 | 46 | 100 | 54 | 19.0 | 22.0 | 0.864 | 12.08 | 12.10 | 0 | 0 | 0 | 3 |
| Example 6 | 6 | 55 | 45 | 100 | 55 | 19.0 | 22.0 | 0.864 | 12.16 | 12.12 | 0 | 0 | 0 | 2 |
| Example 7 | 7 | 59 | 41 | 100 | 59 | 19.0 | 22.0 | 0.864 | 12.24 | 12.34 | 0 | 0 | 0 | 2 |
| Example 8 | 8 | 60 | 40 | 100 | 60 | 19.0 | 22.0 | 0.864 | 12.37 | 12.51 | 0 | 0 | 0 | 1 |
| Example 9 | 9 | 62 | 38 | 100 | 62 | 19.0 | 22.0 | 0.864 | 12.35 | 12.71 | 0 | 0 | 0 | 1 |
| Example 10 | 10 | 63 | 37 | 100 | 63 | 19.0 | 22.0 | 0.864 | 12.34 | 12.72 | 0 | 0 | 0 | 0 |
| Example 11 | 11 | 64 | 36 | 100 | 64 | 19.0 | 22.0 | 0.864 | 12.39 | 12.77 | 0 | 0 | 0 | 0 |
| Example 12 | 12 | 65 | 35 | 100 | 65 | 19.0 | 22.0 | 0.864 | 12.40 | 12.80 | 0 | 0 | 0 | 0 |
| Example 13 | 13 | 70 | 30 | 100 | 70 | 19.0 | 22.0 | 0.864 | 12.39 | 13.30 | 0 | 0 | 0 | 0 |
| Example 14 | 14 | 72 | 28 | 100 | 72 | 19.0 | 22.0 | 0.864 | 12.39 | 13.31 | 0 | 0 | 0 | 0 |
| Example 15 | 15 | 73 | 27 | 100 | 73 | 19.0 | 22.0 | 0.864 | 12.44 | 13.33 | 0 | 0 | 0 | 0 |

TABLE 1-continued

| | ITB# | Film thickness (μm) du | dl | du + dl | du/(du + dl) (%) | CB amount OPL# (% by weight) | IPL# (% by weight) | OPL/IPL | Surface resistivity (Log Ω/□) | Volume resistivity (Log Ω · cm) | Image quality: Cyan 100% Fine white spot | Granularity | Transfer defect | Cyan 30% HT unevenness |
|---|---|---|---|---|---|---|---|---|---|---|---|---|---|---|
| Example 16 | 16 | 75 | 25 | 100 | 75 | 19.0 | 22.0 | 0.864 | 12.64 | 13.40 | 0 | 0 | 1 | 0 |
| Example 17 | 17 | 76 | 24 | 100 | 76 | 19.0 | 22.0 | 0.864 | 12.63 | 13.41 | 0 | 0 | 1 | 0 |
| Example 18 | 18 | 77 | 23 | 100 | 77 | 19.0 | 22.0 | 0.864 | 12.65 | 13.43 | 0 | 0 | 2 | 0 |
| Example 19 | 19 | 78 | 22 | 100 | 78 | 19.0 | 22.0 | 0.864 | 12.69 | 13.62 | 0 | 0 | 2 | 0 |
| Example 20 | 20 | 80 | 20 | 100 | 80 | 19.0 | 22.0 | 0.864 | 12.72 | 13.70 | 0 | 0 | 3 | 0 |
| Example 21 | 21 | 81 | 19 | 100 | 81 | 19.0 | 22.0 | 0.864 | 12.70 | 13.89 | 0 | 0 | 4 | 0 |
| Example 22 | 22 | 82 | 18 | 100 | 82 | 19.0 | 22.0 | 0.864 | 12.69 | 14.00 | 0 | 0 | 4 | 0 |
| Example 23 | 23 | 83 | 17 | 100 | 83 | 19.0 | 22.0 | 0.864 | 12.63 | 14.20 | 0 | 0 | 4 | 0 |
| Example 24 | 24 | 67 | 33 | 100 | 67 | 21.7 | 22.0 | 0.986 | 12.02 | 9.61 | 3 | 0 | 0 | 0 |
| Example 25 | 25 | 67 | 33 | 100 | 67 | 21.4 | 22.0 | 0.973 | 12.04 | 9.81 | 3 | 0 | 0 | 0 |

What is claimed is:

TABLE 2

| | ITB# | Film thickness (μm) du | dl | du + dl | du/(du + dl) (%) | CB amount OPL# (% by weight) | IPL# (% by weight) | OPL/IPL | Surface resistivity (Log Ω/□) | Volume resistivity (Log Ω · cm) | Image quality: Cyan 100% Fine white spot | Granularity | Transfer defect | Cyan 30% HT unevenness |
|---|---|---|---|---|---|---|---|---|---|---|---|---|---|---|
| Example 26 | 26 | 67 | 33 | 100 | 67 | 21.0 | 22.0 | 0.955 | 12.09 | 10.33 | 2 | 0 | 0 | 0 |
| Example 27 | 27 | 67 | 33 | 100 | 67 | 20.3 | 22.0 | 0.923 | 12.21 | 11.02 | 2 | 0 | 0 | 0 |
| Example 28 | 28 | 67 | 33 | 100 | 67 | 20.0 | 22.0 | 0.909 | 12.24 | 11.68 | 1 | 0 | 0 | 0 |
| Example 29 | 29 | 67 | 33 | 100 | 67 | 19.5 | 22.0 | 0.886 | 12.22 | 12.17 | 0 | 0 | 0 | 0 |
| Example 30 | 30 | 67 | 33 | 100 | 67 | 19.0 | 22.0 | 0.864 | 12.31 | 12.79 | 0 | 0 | 0 | 0 |
| Example 31 | 31 | 67 | 33 | 100 | 67 | 18.4 | 22.0 | 0.836 | 12.39 | 13.19 | 0 | 0 | 0 | 0 |
| Example 32 | 32 | 67 | 33 | 100 | 67 | 18.2 | 22.0 | 0.827 | 12.51 | 13.33 | 0 | 1 | 0 | 0 |
| Example 33 | 33 | 67 | 33 | 100 | 67 | 18.0 | 22.0 | 0.818 | 12.49 | 13.79 | 0 | 1 | 0 | 0 |
| Example 34 | 34 | 67 | 33 | 100 | 67 | 17.8 | 22.0 | 0.809 | 12.48 | 13.83 | 0 | 2 | 0 | 0 |
| Example 35 | 35 | 67 | 33 | 100 | 67 | 17.6 | 22.0 | 0.800 | 12.52 | 14.01 | 0 | 2 | 0 | 0 |
| Example 36 | 36 | 67 | 33 | 100 | 67 | 17.5 | 22.0 | 0.795 | 12.53 | 14.05 | 0 | 3 | 0 | 0 |
| Example 37 | 37 | 67 | 33 | 100 | 67 | 17.2 | 22.0 | 0.782 | 12.62 | 14.21 | 0 | 3 | 0 | 0 |
| Example 38 | 38 | 67 | 33 | 100 | 67 | 17.0 | 22.0 | 0.773 | 12.60 | 14.33 | 0 | 4 | 0 | 0 |
| Example 39 | 39 | 67 | 33 | 100 | 67 | 16.5 | 22.0 | 0.750 | 12.65 | 14.34 | 0 | 4 | 0 | 0 |
| Example 40 | 40 | 67 | 33 | 100 | 67 | 16.0 | 22.0 | 0.727 | 12.67 | 14.39 | 0 | 4 | 0 | 0 |
| CE# 1 | 41 | 67 | 33 | 100 | 67 | 22.0 | 22.0 | 1.000 | 11.98 | 9.32 | 6 | 0 | 0 | 0 |
| CE# 2 | 42 | 67 | 33 | 100 | 67 | 22.4 | 22.0 | 1.018 | 11.86 | 9.21 | 6 | 0 | 0 | 0 |
| CE# 3 | 43 | 61 | 33 | 100 | 67 | 23.0 | 22.0 | 1.045 | 11.83 | 8.79 | 6 | 0 | 0 | 0 |
| CE# 4 | 44 | 67 | 33 | 100 | 67 | 24.0 | 22.0 | 1.091 | 11.74 | 8.02 | 6 | 0 | 0 | 0 |
| CE# 5 | 45 | 47 | 53 | 100 | 47 | 22.3 | 22.0 | 1.014 | 11.76 | 9.01 | 6 | 0 | 0 | 6 |
| CE# 6 | 46 | 82 | 18 | 100 | 82 | 22.3 | 22.0 | 1.014 | 11.99 | 10.11 | 6 | 0 | 4 | 0 |

#In Tables 1 and 2, ITB: Intermediate transfer belt; OPL: Outermost periphery layer; IPL: Innermost periphery layer; and CE: Comparative example.

The foregoing description of exemplary embodiments of the present invention has been provided for the purpose of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its applications, thereby enabling others skilled in the art to understand the invention for various embodiments and with the various modifications as are suited to particular use contemplated. It is intended that the scope of the invention be defined by the following claims and their equivalents.

All publications, patent applications, and technical standards mentioned in this specification are herein incorporated by reference to the same extent as if each individual publication, patent application, or technical standard was specifically and individually indicated to be incorporated by reference.

1. An annular body provided at an image forming apparatus, the annular body comprising at least an outermost periphery layer and an innermost periphery layer, each of which comprise carbon black, and a content of carbon black contained per unit of volume of the outermost periphery layer being smaller than a content of carbon black contained per unit of volume of the innermost periphery layer, wherein a film thickness (μm) of the outermost periphery layer du and a film thickness (μm) of the innermost periphery layer dl satisfy the following inequality (4): $55 \leqq du/(du+dl) \times 100 \leqq 78$.

2. The annular body of claim 1, wherein a ratio (A/B) of a content A (% by weight) of the carbon black contained per unit of volume in the outermost periphery layer to a content B (% by weight) of carbon black contained per unit of volume in the innermost periphery layer is in the range of from about 0.78 to about 0.99.

3. The annular body of claim 1, wherein a ratio (A/B) of a content A (% by weight) of the carbon black contained per unit of volume in the outermost periphery layer to a content B (% by weight) of carbon black contained per unit of volume in the innermost periphery layer is in the range of from about 0.80 to about 0.97.

4. The annular body of claim 1, wherein a ratio (A/B) of a content A (% by weight) of the carbon black contained per unit of volume in the outermost periphery layer to a content B (% by weight) of carbon black contained per unit of volume in the innermost periphery layer is in the range of from about 0.81 to about 0.92.

5. The annular body of claim 1, wherein a ratio (A/B) of a content A (% by weight) of the carbon black contained per unit of volume in the outermost periphery layer to a content B (% by weight) of carbon black contained per unit of volume in the innermost periphery layer is in the range of from about 0.83 to about 0.90.

6. The annular body of claim 1, wherein the film thickness (μm) of the outermost periphery layer du and the film thickness (μm) of the innermost periphery layer dl satisfy the following inequality (5): $60 \leqq du/(du+dl) \times 100 \leqq 76$.

7. The annular body of claim 1, wherein: a ratio (A/B) of a content A (% by weight) of the carbon black contained per unit of volume in the outermost periphery layer to a content B (% by weight) of carbon black contained per unit of volume in the innermost periphery layer is in the range of from about 0.78 to about 0.99; and the film thickness (μm) of the outermost periphery layer du and the film thickness (μm) of the innermost periphery layer dl satisfy the following inequality (5): $6 \leqq du/(du+dl) \times 100 \leqq 76$.

8. The annular body of claim 1, wherein the film thickness (μm) of the outermost periphery layer du and the film thickness (μm) of the innermost periphery layer dl satisfy the following inequality (6): $63 \leqq du/(du+dl) \times 100 \leqq 73$.

9. The annular body of claim 1, wherein: a ratio (A/B) of a content A (% by weight) of the carbon black contained per unit of volume in the outermost periphery layer to a content B (% by weight) of carbon black contained per unit of volume in the innermost periphery layer is in the range of from about 0.78 to about 0.99; and the film thickness (μm) of the outermost periphery layer du and the film thickness (μm) of the innermost periphery layer dl satisfy the following inequality (6): $63 \leqq du/(du+dl) \times 100 \leqq 73$.

10. An annular body stretching device, comprising the annular body of claim 1 and a plurality of annular body stretching units rotatably stretching the annular body at an inner surface of the annular body.

11. An image forming apparatus comprising:

an image holder;

a charging device for charging the image holder;

an exposing device for forming an electrostatic latent image on the image holder charged by the charging device;

a developing device for developing the electrostatic latent image as a toner image;

a first transferring device for transferring the toner image from the image holder to an intermediate transfer belt;

a second transferring device for transferring the toner image from the intermediate transfer belt to a transfer receiving medium; and a fixing device for fixing the transferred toner image onto the transfer receiving medium, and the intermediate transfer belt being the annular body of claim 1.

12. The image forming apparatus of claim 11, wherein a surface of a first transferring member which contacts an inner surface of the intermediate transfer belt in the first transferring device is made of a metal.

13. The image forming apparatus of claim 11, wherein a surface of a second transferring member which contacts an inner surface of the intermediate transfer belt in the second transferring device is made of a metal.

14. The image forming apparatus of claim 11, wherein a surface of a second transferring member and a surface of a first transferring member, each of which contacts an inner surface of the intermediate transfer belt in the second transferring device, are respectively made of a metal.

* * * * *